United States Patent [19]

Russell

[11] 4,361,313

[45] Nov. 30, 1982

[54] DISMOUNTABLE BARRIER

[75] Inventor: Lawrence O. Russell, Hamilton, Canada

[73] Assignee: North American Formula Promotions Corporation, Toronto, Canada

[21] Appl. No.: 159,379

[22] Filed: Jun. 13, 1980

Related U.S. Application Data

[63] Continuation of Ser. No. 921,346, Jul. 3, 1978, abandoned.

[30] Foreign Application Priority Data

Mar. 13, 1978 [CA] Canada ..... 298803

[51] Int. Cl.[3] ..... E04H 17/16

[52] U.S. Cl. ..... 256/13.1; 256/19

[58] Field of Search ..... 256/13.1, 1, 26, 24, 256/30, 19; 249/4, 5, 6; 405/284, 285, 273

[56] References Cited

U.S. PATENT DOCUMENTS

| | | | |
|---|---|---|---|
| Re. 29,544 | 2/1978 | Fitch | 256/13.1 |
| 376,936 | 1/1888 | Barton | 256/19 UX |
| 640,377 | 1/1900 | Haentges | 405/273 |
| 1,937,781 | 12/1933 | Patton | 405/285 |
| 2,919,045 | 12/1959 | Waugh | 220/4 |
| 3,288,440 | 11/1966 | Schimmelpenninck | 256/13.1 |
| 3,643,924 | 2/1972 | Fitch | 256/13.1 |
| 3,856,268 | 12/1974 | Fitch | 256/13.1 |
| 3,880,404 | 4/1975 | Fitch | 256/1 |
| 3,916,816 | 11/1974 | Fitch | 116/63 |
| 3,983,956 | 10/1976 | Manhart | 256/13.1 X |
| 4,073,482 | 2/1978 | Seegmiller et al. | 267/139 |

FOREIGN PATENT DOCUMENTS

| | | | |
|---|---|---|---|
| 2317812 | 12/1973 | Fed. Rep. of Germany | 256/13.1 |
| 776756 | 11/1934 | France . | |
| 395442 | 7/1933 | United Kingdom | 249/4 |
| 915133 | 2/1960 | United Kingdom . | |
| 1055341 | 1/1967 | United Kingdom . | |
| 1237445 | 6/1971 | United Kingdom . | |
| 1364885 | 11/1972 | United Kingdom . | |
| 1349076 | 3/1974 | United Kingdom . | |
| 1446152 | 8/1976 | United Kingdom . | |
| 1474787 | 5/1977 | United Kingdom . | |
| 1504926 | 3/1978 | United Kingdom . | |
| 1560563 | 2/1980 | United Kingdom . | |

OTHER PUBLICATIONS

The Fitch Inertial Barrier System–Fitch.
Molded Fiberglass Narrow Median Barrier–R. M. Riddell.

*Primary Examiner*—Andrew V. Kundrat
*Attorney, Agent, or Firm*—Arnold, White & Durkee

[57] ABSTRACT

Dismountable barriers are provided which are readily assembled and dismantled, and consist of easily handled parts. Front and rear rows of vertical horizontally elongated panels are linked end to end by locking bars which can also serve as fence standards, and cross members, preferably also linked to the panels by the locking bars, connect the rows. The space between the panels is filled with sand, gravel or other fluent material, except that cross panels may prevent the cross members and locking bars from being submerged. Short panels may be inserted between the elongated panels on one side of the barrier where it is necessary to form a bend in the latter.

29 Claims, 7 Drawing Figures

DISMOUNTABLE BARRIER

This is a continuation, of application Ser. No. 921,346, filed July 3, 1978 now abandoned This invention relates to dismountable barriers, especially useful as crash barriers for vehicles and crowd control barriers, but also useful for many other purposes.

There are many occasions upon which a temporary barrier is required which can be readily assembled and dismantled but which must yet be extremely strong and resistant to displacement as the result of impact or crowd pressure. A typical application for such barriers is to protect spectators at motor races where the course or part of it is of a temporary nature.

One form of barrier which has been used for this purpose consists of a row of massive concrete blocks linked to one another and supporting standards carrying a wire mesh fence. Such a barrier has a number of disadvantages. The concrete blocks are extremely massive, and must therefore be handled by cranes as well as presenting a formidable storage and transportation problem. When resting on the ground, particularly if the latter is rigid but uneven so that it only makes limited contact with the blocks, the blocks can be shifted a significant distance by a heavy impact. The rigidity of the blocks may contribute the deflecting an impacting vehicle back into the path of other vehicles in the case of a glancing blow, and increases the deceleration to which the vehicle is subject under crash conditions and thus the risk of injury to the driver.

A further form of barrier has been formed of drums placed side by side and filled with sand. The bottoms of the drums are open and thus frictional contact between the sand and the ground provides an effective anchor against movement on impact. However, the appearance of such a barrier is poor, and in most cases a continuous supplementary barrier is required in front of the drums to provide a reasonably smooth surface to protect impacting vehicles. Such a supplementary barrier may itself impart undesirable safety characteristics to the barrier as well as increasing its cost and complexity. Although the drums are easily handled before filling with sand, they are very bulky, and a crane is still necessary to pull the drums off the sand after use. A further disadvantage in many applications of temporary barriers is that the drums do not provide a suitable surface for carrying advertising.

An object of the present invention is to provide a dismountable barrier which is effective and has good safety characteristics, which is readily assembled and dismantled without the necessity for heavy lifting gear, which provides a smooth outer surface which minimises damage to impacting objects such as vehicles and which is suitable for carrying advertising, which is well adapted for supporting a fence extending the height of the barrier, and which is relatively light and compact to transport.

According to the invention a dismountable barrier comprises two parallel rows of vertically extending rectangular panels which when assembled rest on the ground in substantial end to end abutment, connection means extending internally of the assembled area to connect panels to adjacent panels in the same row as well as panels in the other row so as to maintain said panels in said rows with said panels presenting generally smooth and unobstructed external surfaces and so as to brace said panels against moving apart, the panels having inturned lower flanges, and a mass of dense non-self-supporting material filling most of the space between said rows of panels and resting partially on said lower flanges. By dense non-self-supporting material is meant a fluent or particulate material at least as dense as water.

The connection means typically include transverse link members, and preferably locking bars are provided to connect brackets linking adjacent panels with the cross members, with some at least of the locking bars extended upwardly to form standards supporting a fence above the barrier. Preferably the panels also have inturned flanges at their upper edges. Preferably the transverse link members have apertures at their ends aligned with the apertures in the brackets, and the locking bars also pass through the apertures in the link members.

Preferably also, transverse vertical panels are provided to either side of the links and the locking bars so as to prevent the latter from being submerged in the filling material. The panels are preferably of two lengths, long panels arranged in aligned pairs in the two rows, and short panels interposed between long panels in the outside of a curve in the barrier.

Other features of the invention will become apparent from the following description of a preferred embodiment of a barrier in accordance with the invention, with reference to the accompanying drawings, in which.

Figure 1:
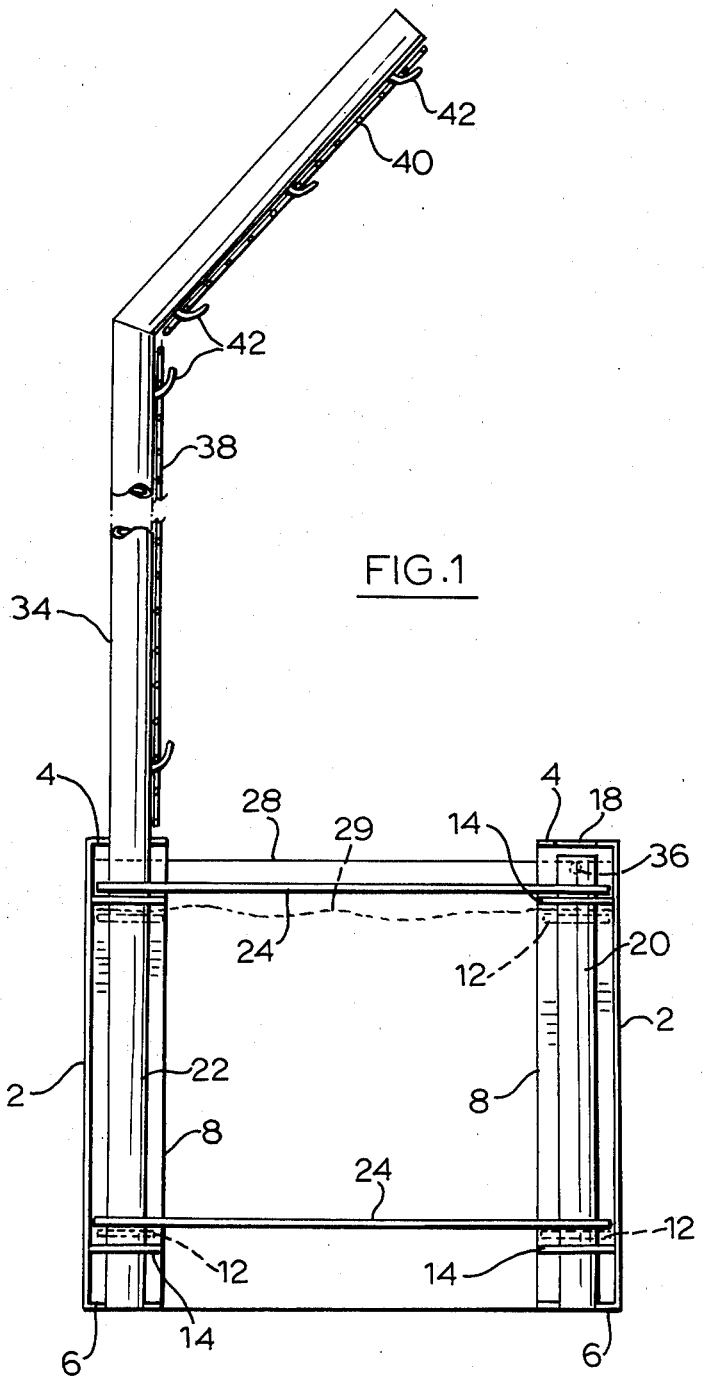
FIG. 1 is an end view of the barrier.
Figure 2A:
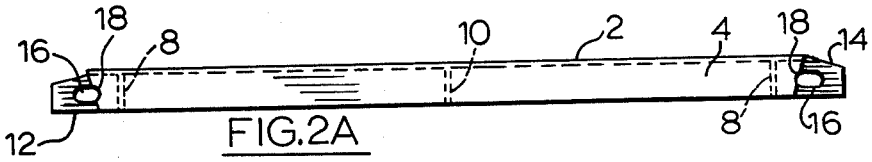
FIGS. 2A, 2B and 2C show plan and end and side elevational views of a front or rear panel used in the barrier.
Figure 2B:
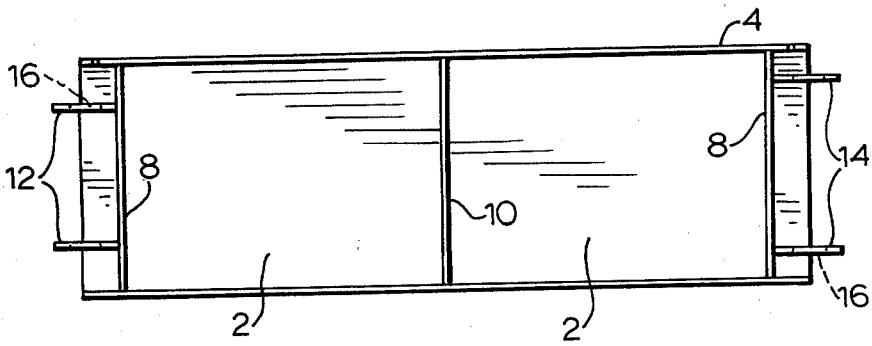
Figure 2C:
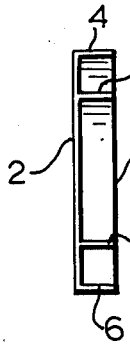

Referring to the drawings, a straight section of barrier comprises two parallel rows of panels 2, as shown in more detail in FIGS. 2A, 2B & 2C. The panels are typically formed of sheet steel of gauge just sufficient to sustain pressures applied thereto when the barrier is assembled without substantial distortion, as is discussed further below. The panels have inturned flanges 4 and 6 at top and bottom, and are braced by welded vertical end ribs 8 and intermediate ribs 10. Welded to the panel and the ribs 8 are vertically spaced pairs of brackets 12 and 14, those at one end of the panels being somewhat more widely spaced than those at the other end. All of the brackets are spaced away from the top and bottom flanges of the panels. Typically, the overall length of the panels including the brackets is 120 inches, the height is 32 inches, and the depth of the ribs 8 and 10 and the flanges 4 and 6 is 5 inches, the brackets 12 and 14 extending 2.5 inches beyond the ends of the panels. The panels are light enough to handle manually. The brackets 12 are spaced 4 inches from the flanges and brackets 14 are spaced 3 inches from the flanges. The brackets are formed with vertically aligned slightly elongated apertures 16, and the flanges 4 and 6 are cut away at 18 in line with these apertures so that adjacent panels 2 can be linked end to end by vertical locking bars 20 or 22 (see FIG. 1) which pass through the apertures. The elongation of the apertures 16 allows for slight misalignment between the panels if the ground on which they are placed is not level. It will be noted that all of the various projecting portions and fittings associated with the panel, such as the brackets used to connect the panels, project inwardly of the external surface when the panel is in use, thus leaving the external surface unobstructed. Since the brackets at opposite ends of the panels are at different levels, (see broken line brackets 12 in FIG. 1) there is no interference between the brackets.

Panels on opposite sides of the barrier are linked internally of the barrier by transverse members 24 which also have apertures 26 which are vertically alignable with those in the brackets 12 and 14 so that they also can be locked by the bars 20 and 22, the transverse members 24 and the bars 20 and 22 forming linking members which cooperate with the brackets 12 and 14 to form releasable connecting means extending internally between the rows of panels 2 in the assembled barrier to connect the panels into rows and the rows to each other. Panels 28, which may be of light gauge metal, plywood or any other sufficiently rigid material, are fitted against the inner surfaces of the ribs 8 so as to contain material 29 used to fill the interior of the open bottomed container formed by the panels 2 and 28. This material may be any dense non-self-supporting material, for example, sand, shingle, crushed rock or loose soil, or even water if a suitable waterproof liner of for example plastic film is placed within the container. In order to give the barrier the necessary mass to resist displacement, materials substantially less dense than water would not normally be suitable. The use of the panels 28 is desirable to prevent the brackets 12 and 14 and the members 24 from being submerged in the filling material. This facilitates withdrawal of the locking bars when the barrier is to be disassembled. The lower flanges 4 sustain part of the weight of the filling material, which helps to hold the panels in place and thus resists overturning of the barrier during use.

Figure 3:
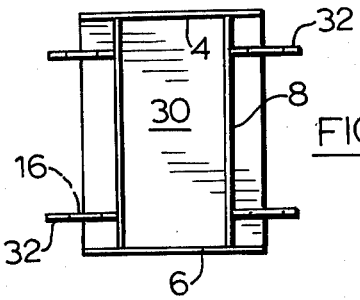
FIG. 3 shows a side elevation of a corner panel.
Figure 4:
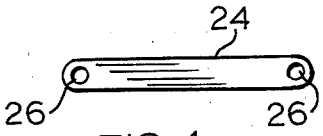
FIG. 4 is a plan view of a transverse link used in the barrier.
Figure 5:
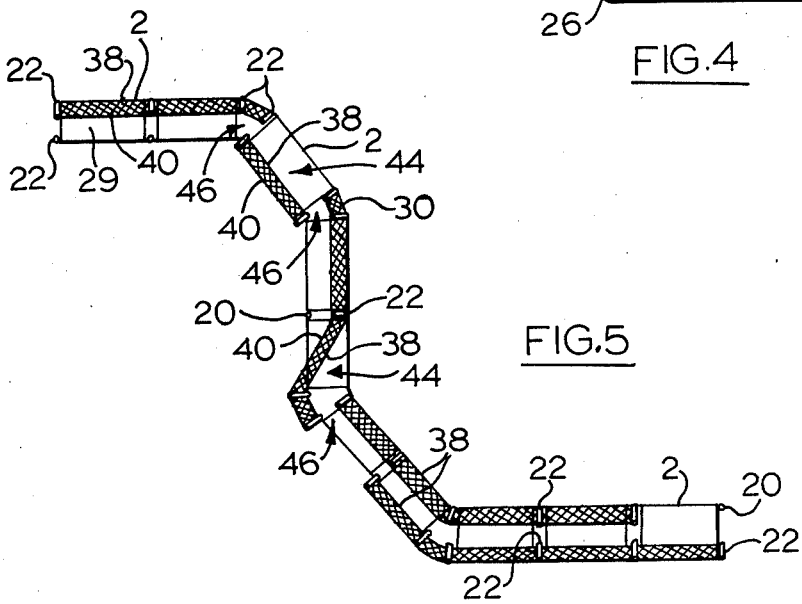
FIG. 5 is a plan view, on a reduced scale, of an extended length of the barrier.

In order to enable the barrier to be erected in other than straight configurations, corner panels 30 are provided as shown in FIG. 3. The panels 30 of similar steel sheet to that used for panels 2, and have similar top and bottom flanges 4 and 6 and end ribs 8. However, its brackets 32 are at the same heights at both ends, those heights being intermediate these of the brackets 12 and 14 which they otherwise resemble. Thus by use of two locking bars 20 or 22 two panels 2 may be linked by a panel 30 without any of the brackets 12, 14 and 32 interfering with one another. FIG. 5 illustrates how the various panels can be linked to provide a barrier of a desired configuration.

In many applications, a fence will be required on top of the barrier, as shown in FIGS. 1 and 5. Such a fence is conveniently supported by standards 34 which form upward extensions of the locking bars 22; unextended locking bars 20 are used where fencing standards are not required and may be provided with cross pins 36 to facilitate handling, both types of bar being formed typically from 2 inch diameter steel tube. In the embodiment shown, the standards 34 are bent over at the top ends, and wire mesh panels 38 and 40 may be hung onto hooks 42 welded to the standards. The upright portions of the standards may conveniently project 96 inches above the barrier to suit standard width of wire mesh. The inclined portions of the standards may be connected by wire stringers if desired.

Normally the barrier will be used to exclude people from an area and/or to contain a hazard within that area, which may be for example an arena or race track. For convenience, the side of the barrier facing the contained area will be regarded as the front. The fence just described may run along either the front or the rear side of the barrier, or alternate between them, as shown in FIG. 5. In some cases even a double fence may be required, again as shown in FIG. 5, or alcoves 44 may be provided for the convenience of, for example, race marshals with openings 46 allowing access to either side of the barrier. In some cases the fence will not be required, in which case only the locking bars 20 need be used. If a taller barrier is required, more than one tier of rows of panels may be used, with appropriately extended locking bars.

There is also considerable scope for modification to the structure of the barrier. Thus the connecting means used releasably to connect the panels into opposite rows may be varied; for example, the cross members could be separately linked between the panels without relying on the locking bars, and could be of different configuration. Moreover, although this has considerable disadvantages from the storage and transportation aspects, and also makes dismantling of the barrier more difficult, the panels 2, cross members 24 and panels 28 could be formed as a unitary box structure. The dimensions quoted are of course only exemplary.

Although the invention has been described with special reference to its use as a crash and crowd control barrier, it has a wide range of usefulness wherever a strong yet easily erected and dismounted barrier is required. It could be used for example to provide temporary security enclosures for vehicles or stored goods, or temporary traffic engineering works for reorganizing traffic flows on a short-term or experimental basis. It could also be used to enclose an area of ice to form a hockey arena. Many other uses will be apparent to those skilled in the art.

The front of the barrier provides a smooth surface ideal for carrying advertising, and the end to end abutment of the panels 2 and 30 and the inturned top flanges 4 provide unobstructed external surfaces in the direction of the barrier so as to minimize the hazard to vehicles or persons colliding with the barrier. The relatively light gauge of the panels and the non-self-supporting nature of the filling means that the barrier is quite effective in absorbing impact energy and has a reduced tendency to throw impacting vehicles back into the path of other vehicles. The individual components of the barrier are light enough to be manhandled, and the barrier can be dismantled without having to be lifted off the filling material by heavy lifting gear.

There may be some applications, for example median barriers on divided highways, where a centrally located fence would be desirable. In such a case, the fencing standards may be located by apertures midway along the transverse members 24.

What I claim is:

1. A dismountable barrier comprising two parallel rows of generally vertical planar rectangular panels resting on the ground in substantial end to end abutment, the panels having inturned lower flanges, vertically spaced brackets at each end of said panels, the brackets of abutting panels overlapping and each having apertures in mutual vertical alignment, transverse link members extending between the ends of panels in said rows so as to brace said panels against moving apart, said transverse link members having apertures at their ends aligned with the apertures in the brackets, generally vertical locking bars passing through said apertures in said brackets and said link members, and a mass of dense non-self-supporting material filling most of the space between said rows of panels and resting on the ground.

2. A barrier according to claim 1, wherein the panels have inturned flanges at their upper edges.

3. A barrier according to claim 1, wherein some at least of the locking bars are extended upwardly to form standards supporting a fence above the barrier.

4. A barrier according to claim 1, further comprising transverse vertical panels provided to either side of the links and the locking bars whereby to prevent the latter from being submerged in the filling material.

5. A barrier according to claim 1, wherein the brackets extend beyond the ends of the panels.

6. A barrier according to claim 1, wherein the panels in the two parallel rows are of different lengths, including long panels arranged in parallel pairs, and short filler panels interposed between the long panels at the outside of corners in the barrier.

7. A barrier according to claim 6, wherein the brackets extend beyond the ends of the panels, the brackets at opposite ends of the long panels being at different heights, and the brackets on the filler panels being at yet further different heights.

8. A dismountable barrier comprising two parallel rows of generally vertical planar rectangular panels resting on the ground in substantial end to end abutment, the panels having inturned lower flanges, vertically spaced brackets at each end of said panels, the brackets of abutting panels overlapping and each having apertures in mutual vertical alignment, generally vertically locking bars passing through said apertures, some at least of the locking bars being extended upwardly to form standards supporting a fence above the barrier, transverse link members extending between the ends of panels in said rows so as to brace said panels against moving apart, and a mass of dense non-self-supporting material filling most of the space between said rows of panels and resting on the ground.

9. A dismountable barrier comprising two parallel rows of generally vertical planar rectangular panels resting on the ground in substantial end to end abutment, the panels having inturned lower flanges, vertically spaced brackets at each end of said panels, the brackets of abutting panels overlapping and each having apertures in mutual vertical alignment, generally vertical locking bars passing through said apertures, transverse link members extending between the ends of panels in said rows so as to brace said panels against moving apart, and a mass of dense non-self-supporting material filling most of the space between said rows of panels and resting on the ground and on said flanges, the panels in the two parallel rows being of different lengths, including long panels arranged in parallel pairs, and short filler panels interposed between the long panels at the outside of corners in the barrier.

10. A dismountable barrier comprising two parallel rows of vertically extending panels resting on the ground and configured so as to define substantially smooth and unobstructed external side surfaces of the barrier, said panels having inturned flanges at their lower edges, cross members extending internally between said rows of panels, vertically withdrawable locking members slidably engaging with brackets formed in said panels internally of said external surfaces so as simultaneously to connect said cross members to the panels and link the ends of adjacent panels in a row to one another, and a mass of dense non-self-supporting material filling most of the space between said rows of panels and resting upon the ground and upon said flanges.

11. A barrier assembly for forming a readily erected and dismounted elongated barrier comprising a plurality of panels each presenting an internal surface having inwardly projecting members at opposite end regions and an inwardly projecting flange along at least one edge adapted to constitute a bottom edge during use, and each panel presenting an external surface which is generally smooth and unobstructed in the direction of the bottom edge, and a plurality of linking members comprising cross members and locking members, the cross members and locking members of the linking members and the inwardly projecting members of the panels being configured so that each locking member is slidable in a direction transverse to the panel bottom edge into engagement with the inwardly projecting members proximate adjacent ends of two panels when the panels are aligned in two longitudinally extending parallel rows on a supporting surface so as to extend generally vertically with their external surfaces outward, and so that each locking member is slidably engageable with a cross member to connect said panels into said rows and said cross members so as to extend between said rows to provide an elongated partially open-bottomed barrier adapted to contain a mass of dense non-self-supporting material resting partly on said flanges to support the panels and a formed elongated barrier against overturning under impact.

12. A barrier assembly according to claim 11, wherein the locking members are bars, and the cross members and inwardly projecting members have apertures which are vertically alignable to receive said bars.

13. A barrier assembly according to claim 12, wherein certain of the bars are elongated to provide fence support standards when the barrier is erected.

14. A readily erected and dismounted elongated free standing roadway barrier assembly for flanking a roadway, comprising a plurality of panels flanged at at least one edge, said panels being disposable in two parallel rows on a supporting surface to present continuous outwardly directed vertically extending surfaces which are generally smooth and unobstructed in the longitudinal direction of the rows, and to present inturned lower flanges which are shaped to partially cover such a supporting surface between the rows and which are disposed to support a sufficient part of the weight of dense non-self-supporting material introduced between said rows for such material to restrain lifting of the panels and to support the panels and the barrier against overturning under impact during use, and releasable connecting means adapted to extend internally between said panels when so disposed in rows to connect said panels into said rows and said rows to each other, the connecting means being shaped to maintain the panels in laterally spaced relationship for material introduced between the rows to rest on such a supporting surface and thereby restrain lateral displacement of the barrier under impact.

15. A barrier assembly according to claim 14, wherein said releasable connecting means comprise locking members vertically insertable into and withdrawable from locations between and engaging the panels when disposed in rows.

16. A barrier assembly according to claim 14, wherein said releasable connecting means comprise brackets secured to and extending from end regions of said panels inwardly of said outwardly directed surfaces, cross members disposable between two rows of the panels with apertures therein aligned with further apertures in said brackets, and locking members insertable from above through said apertures when aligned.

17. A barrier assembly according to claim 15 or 16, wherein at least certain of said locking members are elongated so as to extend above said barrier when erected and form fencing standards.

18. A roadway barrier member adapted to be assembled with corresponding barrier members removably connected to opposed ends thereof for forming on a supporting surface an elongated easily dismountable free standing roadway flanking barrier having a pair of opposed, outwardly directed external surfaces which are generally smooth and free from outwardly projecting obstructions in the direction of the elongated barrier, the barrier member comprising:

(a) a pair of panels for positioning along a bottom edge of each panel on such a supporting surface in laterally spaced relationship, and (b) connecting means for removably connecting the panels, the connecting means comprising cross member means to be positioned to extend internally between the panels, the cross member means being shaped to maintain the panels in their laterally spaced relationship for removable particulate filler material housed between the panels to engage with such a supporting surface between the panels;

each panel having an interior and an exterior surface, panel fittings being provided for each panel extending internally of its exterior surface to cooperate with the connecting means and to cooperate with panel fittings of corresponding barrier members for the connection of the panels of the member to the panels of such corresponding barrier member, and each panel having an inturned flange proximate its bottom edge to be directed inwardly during use, each flange being such as to be capable of being engaged sufficiently by removable particulate filler material housed between the panels during use to allow such a filler material to support the barrier member in its erected free standing condition and to restrain the panels against lifting and the barrier member against overturning under impact during use.

19. A member according to claim 18, in which the connecting means further comprises locking members removably engageable with the panel fittings and with the cross member means to connect the cross member means to the panels and simultaneously to connect the panels to panels of a corresponding barrier member.

20. A member according to claim 18 or claim 19, in which the panels of the member are corresponding panels, and in which each panel has the panel fittings provided adjacent its opposed ends, the panel fittings at the opposed ends being arranged complementarily to each other to allow mating with the panel fittings of a corresponding panel when positioned at either end thereof.

21. A member according to any one of claims 18 to 20, in which each panel is generally planar.

22. A member according to any one of claims 18 to 20, in which each panel is generally rectangular.

23. For use in the assembly and disassembly of an easily dismountable elongated free standing roadway barrier resting upon a support to flank a roadway, a group of cooperating members comprising:

a plurality of panels each (a) having an exterior surface and an interior surface, (b) having along its interior surface proximate a bottom edge, a flange extending significantly inwardly in the direction substantially opposite said exterior surface and adapted to be engaged by and held by the weight of particulate ballast material conformable to the shape of the barrier interior;

(c) panel defining at least two vertically spaced apertures inwardly of the exterior surface adjacent each panel end adjoining said bottom edge, such apertures being adapted to align with similar apertures of adjoining panels to afford removable locking of pairs of said panels into a row to form an elongated barrier wall on a support surface;

(d) having its exterior surface substantially free of obstruction in a direction generally parallel to the bottom edge;

a plurality of cross members adapted to afford cross-linking between parallel pairs of said panels; and a plurality of removable connector fittings for simultaneous engagement with said panel apertures and with said cross members, the structures of the panels, fittings and cross members being such that:

(a) pairs of said panels may be secured to each other to form a first elongated barrier wall, and (b) others pairs of said panels may be secured to form a second elongated barrier wall maintained in substantially parallel spaced relationship with said first barrier wall by said cross members, (c) said barrier walls may have said flanges and fittings extending within their external surfaces so that the exterior of the barrier walls may be substantially free of obstruction in the direction of the elongated wall, and (d) said barrier walls may define a space between them for receipt of particulate ballast material to rest on a support surface for locating the barrier on the surface and to engage said flanges and thereby provide stability to the barrier against easy overturning.

24. The invention of claim 23, wherein the connector fittings include integral parts which can be easily removed so as to release simultaneously the joining of said pairs of panels in a barrier wall both to each other and to the cross members whereby the panels may be pulled aside from the ballast for easy disassembly and moving of the barrier to a new location.

25. The invention of claim 23 or 24, wherein at least one of the connector fittings includes as part thereof a panel portion to span the space between the barrier walls to provide an end wall formation to a section of the barrier when assembled.

26. A barrier assembly according to claim 14, in which the releasable connecting means comprises cross members disposable between two rows of panels with apertures to align with apertures of the panels for connecting the cross members to the panels.

27. A barrier assembly according to claim 26, in which the releasable connecting means further comprises locking members which are insertable through the apertures when aligned to lock the cross members to the panels.

28. A roadway barrier member adapted to be assembled with corresponding barrier members removably connected to opposed ends thereof for forming on a supporting surface an elongated easily dismountable free standing roadway flanking barrier having a pair of opposed, outwardly directed external surfaces at least one of which is generally smooth and free from outwardly projecting obstructions in the direction of the elongated barrier, the barrier member comprising:

(a) a pair of panels for positioning along a bottom edge of each panel on such a supporting surface in laterally spaced relationship, and (b) connecting means for removably connecting the panels, the connecting means comprising cross member means to be positioned to extend internally between the panels, the cross member means being shaped to maintain the panels in their laterally spaced relationship for removable particulate filler material housed between the panels to engage with such a supporting surface between the panels;

each panel having an interior and exterior surface, panel fittings being provided for each panel with the panel fittings of at least one panel extending internally of its exterior surface to cooperate with the connecting means and to cooperate with panel fittings of corresponding barrier members for the connection of the panels of the member to the panels of such corresponding barrier member, and each panel having an inturned flange proximate its bottom edge to be directed inwardly during use, each flange being such as to be capable of being engaged sufficiently by removable particulate filler material housed between the panels during use to allow such a filler material to support the barrier member in its erected free standing condition and to restrain the panels against lifting and the barrier members against overturning under impact during use.

29. A roadway barrier member according to claim 28, in which the panels of the pair are corresponding panels.

* * * * *